US009234662B2

(12) United States Patent
Wang et al.

(10) Patent No.: US 9,234,662 B2
(45) Date of Patent: Jan. 12, 2016

(54) AIR FUEL PREMIXER HAVING ARRAYED MIXING VANES FOR GAS TURBINE COMBUSTOR

(71) Applicant: Institute of Engineering Thermophysics, Chinese Academy of Sciences, Beijing (CN)

(72) Inventors: Yue Wang, Beijing (CN); Zongming Yu, Beijing (CN); Wenjun Kong, Beijing (CN); Baorui Wang, Beijing (CN); Yuhua Ai, Beijing (CN)

(73) Assignee: The Institute of Engineering Thermophysics, The Chinese Academy of Sciences, Beijing (CN)

( * ) Notice: Subject to any disclaimer, the term of this patent is extended or adjusted under 35 U.S.C. 154(b) by 610 days.

(21) Appl. No.: 13/675,588

(22) Filed: Nov. 13, 2012

(65) Prior Publication Data

US 2013/0133329 A1 May 30, 2013

(30) Foreign Application Priority Data

Nov. 25, 2011 (CN) ..... 2011 1 0380006

(51) Int. Cl.

| | |
|---|---|
| ***F23R 3/28*** | (2006.01) |
| ***F23R 3/18*** | (2006.01) |
| ***F23R 3/14*** | (2006.01) |

(52) U.S. Cl.

CPC . *F23R 3/286* (2013.01); *F23R 3/14* (2013.01); *F23R 3/18* (2013.01); *F05D 2240/127* (2013.01); *F05D 2260/2212* (2013.01); *F23C 2900/07001* (2013.01)

(58) Field of Classification Search

CPC ..... F23R 3/14; F23R 3/286; F23R 3/18; F05D 2240/127; F05D 2260/2212; F23C 2900/07001

See application file for complete search history.

(56) References Cited

U.S. PATENT DOCUMENTS

| | | | | |
|---|---|---|---|---|
| 2,632,300 | A * | 3/1953 | Brzozowski | 60/749 |
| 2,755,623 | A * | 7/1956 | Ferri et al. | 568/868 |
| 3,817,690 | A * | 6/1974 | Bryce et al. | 431/350 |

(Continued)

FOREIGN PATENT DOCUMENTS

| | | | |
|---|---|---|---|
| CN | 10 1040149 | A | 9/2007 |
| CN | 10 2235672 | A | 11/2011 |
| EP | 2 239 501 | A1 | 10/2010 |

OTHER PUBLICATIONS

Office Action for Chinese Application No. 201110380006.2 dated Jun. 20, 2014.

(Continued)

*Primary Examiner* — Thomas Denion
*Assistant Examiner* — Xiaoting Hu
(74) *Attorney, Agent, or Firm* — Alston & Bird LLP

(57) ABSTRACT

A fuel-air premixer for use in a combustor of a gas turbine includes an air inlet, a fuel inlet, a shroud, a central body and a cascade of vanes. The premixer mixes fuel and air in the annular mixing passage into a uniform mixture for injecting into a combustor reaction zone. The air from a compressor is injected into the mixer through an air inlet. The fuel is introduced into air stream via fuel injection holes that pass through the walls of the vanes which contain internal fuel flow passages. The flow field inside the premixer is broken up by the arrayed vanes into a series of small regions each containing a well designed small size mixing eddy which is steadily attached to the surface of the vanes.

6 Claims, 2 Drawing Sheets

(56) References Cited

U.S. PATENT DOCUMENTS

| | | | | | |
|---|---|---|---|---|---|
| 4,255,124 | A | | 3/1981 | Baranowski, Jr. | |
| 4,445,339 | A | * | 5/1984 | Davis et al. | 60/749 |
| 5,259,184 | A | | 11/1993 | Borkowicz et al. | |
| 5,267,851 | A | * | 12/1993 | Washam et al. | 431/9 |
| 5,295,352 | A | * | 3/1994 | Beebe et al. | 60/776 |
| 5,345,768 | A | * | 9/1994 | Washam et al. | 60/737 |
| 5,435,126 | A | * | 7/1995 | Beaudoin | 60/39.463 |
| 5,836,163 | A | * | 11/1998 | Lockyer et al. | 60/737 |
| 6,050,096 | A | * | 4/2000 | Senior | 60/748 |
| 6,438,961 | B2 | | 8/2002 | Tuthill et al. | |
| 2002/0011070 | A1 | * | 1/2002 | Mandai et al. | 60/725 |
| 2004/0050057 | A1 | * | 3/2004 | Bland et al. | 60/737 |
| 2007/0089426 | A1 | * | 4/2007 | Vandale et al. | 60/776 |
| 2009/0113895 | A1 | * | 5/2009 | Steele et al. | 60/780 |
| 2009/0241547 | A1 | * | 10/2009 | Luts et al. | 60/737 |
| 2010/0095675 | A1 | | 4/2010 | Lacy et al. | |
| 2012/0015309 | A1 | | 1/2012 | Stewart | |
| 2012/0297786 | A1 | * | 11/2012 | Crawley et al. | 60/772 |

OTHER PUBLICATIONS

Office Action for Chinese Application No. 201110380006.2 dated Sep. 9, 2014.

* cited by examiner

AIR FUEL PREMIXER HAVING ARRAYED MIXING VANES FOR GAS TURBINE COMBUSTOR

CROSS-REFERENCE TO RELATED APPLICATION

This application claims the benefit of Chinese Patent Application No. 201110380006.2 filed on Nov. 25, 2011 in the State Intellectual Property Office of China, the whole disclosure of which is incorporated herein by reference.

BACKGROUND OF THE INVENTION

1. Field of Invention

The present invention relates to gas turbines and, in particular, to a fuel-air premixer for a combustor of a gas turbine which uniformly mixes fuel and air so as to reduce Nitrogen Oxide (NOx) formed by the combustion progress.

2. Description of the Related Art

The worldwide concerns of air pollution have led to stricter emission standards requiring significant reduction in gas turbine pollution emission. NOx, which is an inducement to atmospheric pollution, is generally formed in the high temperature regions of the gas turbine combustor by direct oxidation of atmospheric nitrogen with oxygen. Thus reducing the emission of NOx can be achieved by decreasing the temperature of the reaction zone. And one preferred method is to premix fuel and air into a lean mixture prior to combustion. The thermal mass of the excess air absorbs heat and decreases the temperature of the reaction products.

There are several problems associated with dry low emissions combustors operating with lean premixing of fuel and air. Specifically, there is a tendency for flammable mixture of fuel and air within the premixing section of the combustor to combust due to flashback, which occurs when flame propagates from the combustor reaction zone into the premixing section, or auto-ignition, which occurs when the dwell time and temperature of the fuel-air mixture in the premixing section are sufficient for combustion to be initiated without an igniter. The combustion in the premixing section results in degradating of emission performance, and overheating and damaging of the premixing section. Therefore, a problem to be solved is to prevent flashback and auto-ignition within the premixer.

In addition, the fuel and air must be uniformly mixed in the premixer and the reaction zone of the combustor so as to achieve a desired emission performance. In regions in the flow field in which the fuel concentration of the mixture is significantly greater than an average, the temperature of the reaction products in these regions will be higher than an average, and thus a large quantity of thermal NOx will be produced, which makes the combustor fail to meet NOx emission requirements. In regions in the flow field in which the fuel concentration of the mixture is significantly leaner than the average, quenching may occur and oxidizing progress of the hydrocarbons or carbon monoxide may be terminated before reaching equilibrium levels, this can result in failure to meet carbon monoxide (CO) or unburned hydrocarbon (UHC) emission requirements. Thus, another problem to be solved is to mix the fuel and the air with significant uniform concentration distribution in the premixer to meet the emission performance requirements.

Still further, in order to meet emission performance requirements imposed upon the gas turbine in many applications, it is necessary to reduce the fuel concentration of the mixture to a level that is close to the lean flammability limit for most fuels. This results in a reduction in flame propagation speed as well as emissions. As a consequence, lean premixing combustors tend to be less stable than the conventional diffusion flame combustors, and often result in high level combustion driven dynamic pressure activities which often lead to hardware damage, flashback or blowoff. Thus, yet another problem to be solved is to control the combustion driven dynamic pressure activity to an acceptable low level.

Lean, premixing fuel injectors for emission abatement are commonly used in heavy duty industrial gas turbines. A representative example of such a device is described in U.S. Pat. No. 5,259,184. Such devices have achieved great progress in the gas turbine exhaust emission abatement by reducing the NOx emissions by an order of magnitude or more relative to the diffusion flame burners without using diluent injection. The advantages in emission performance, however, have been obtained at the expense of incurring several problems. In particular, flash back and flame holding within the premixer result in degradation of emission performance and hardware damage due to overheating. In addition, the high level combustion driven dynamic pressure activity results in the problems such as flashback, blowoff, and the reduction in the useful life of the combustor hardware.

An example of a method for reducing the combustion driven dynamic pressure activity in lean premixed dry low emissions combustors can be found in U.S. Pat. No. 6,438,961, which proposed an inlet flow conditioner upstream of the premixer inlet to improve the air flow velocity distribution through the premixer and the uniformity of the fuel-air mixture in the premixer, which successfully reduces the premixing flow sensitivity to the air flow mal-distribution in the flow field approaching the premixer.

Though those conventional premixers have achieved progress in premixing fuel and air without introducing some associated problems in premix combustion, much improvement is still needed. The first is to reduce the fuel-air mixing non-uniformity in the premixer which limits the combustors to achieve maximum emission reduction. The second is to resist or prevent the flashback and auto-ignition in the case of various operation conditions and different fuels. The third is to reduce the level of combustion driven dynamic pressure activity so as to obtain high combustion performance in the combustors.

SUMMARY OF INVENTION

In accordance with one aspect of the present invention, a fuel-air premixer for use in a combustor of a gas turbine includes an air inlet, a fuel inlet, a shroud, a central body and a cascade of vanes. The premixer mixes fuel and air in the annular mixing passage into a uniform mixture for injecting into a combustor reaction zone. The central body comprises a non-airfoil downstream end. The air from a compressor is injected into the mixer through an air inlet. The fuel is introduced into an air stream via fuel injection holes that pass through the walls of the vanes which contain internal fuel flow passages. The flow field inside the premixer is broken up by the arrayed vanes into a series of small regions each contains a small size mixing eddy which is steadily attached to the surface of the vanes. By premixing fuel and air in this manner, the concentration distribution of the mixture flow out of the premixer is perfectly uniform, the large scale turbulent of the air flow is absorbed and the problems of flashback and auto-ignition for the premixer are eliminated.

BRIEF DESCRIPTION OF THE DRAWINGS

These and other aspects and advantages of the invention will become apparent from the following detailed description of the invention, with reference to the accompanying drawings, in which.

DETAILED DESCRIPTION OF PREFERRED EMBODIMENTS

Figure 1:
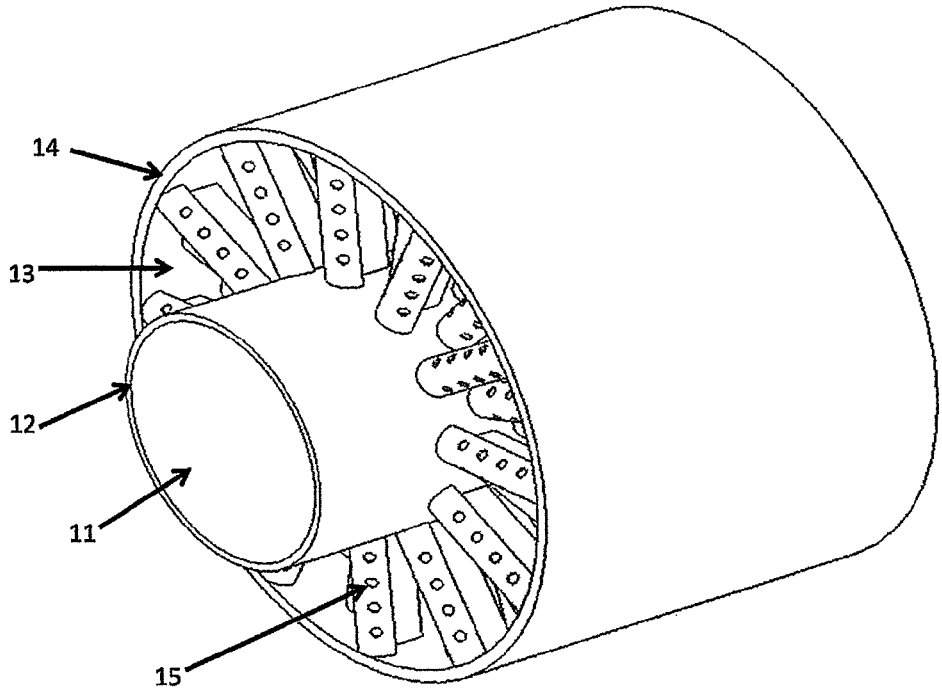
FIG. 1 is a schematic view showing the appearance of the premixer according to one exemplary embodiment of the present invention.

Preferred embodiments of the present invention will be described hereinafter in detail with reference to the attached drawings, wherein the like reference numerals refer to the like elements throughout the specification. These embodiments should not be construed as being limited to the embodiment set forth herein, rather for illustrative purpose.

Figure 2:
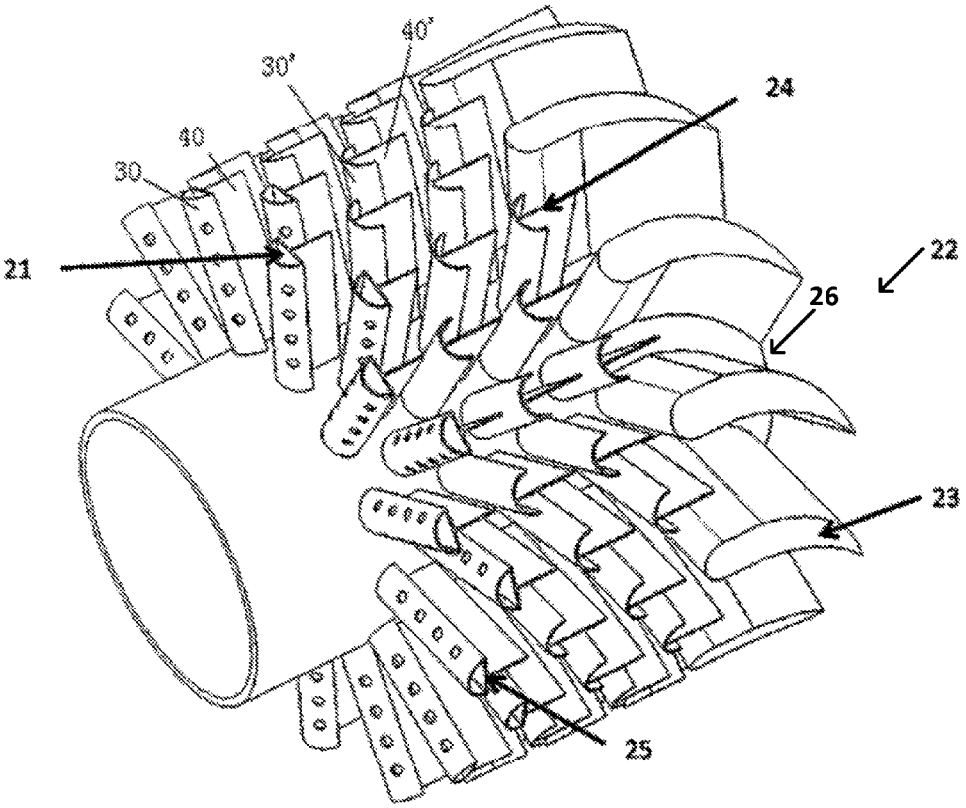
FIG. 2 is a perspective view showing the inner vanes of the premixer according to one exemplary embodiment of the present invention.

FIG. 1 shows the appearance of the premixer according to one exemplary embodiment of the invention, and FIG. 2 schematically shows the details of the shape and arrangement of the arrayed vanes.

The fuel-air premixer of the present invention for use in a combustor of a gas turbine includes an air inlet, a fuel inlet 11, a shroud 14, a central body 12 and a cascade of vanes 25,24, 23. The premixer mixes fuel and air in an annular mixing passage 13 into a uniform mixture for injecting into a combustor reaction zone through the exhaust 22.

High pressure air discharged from a compressor enters the premixer through the air inlet, which is located at an upstream end of the annular mixing passage 13 confined by a solid cylindrical inner wall of the shroud 14 and a cylindrical outer wall of the central body 12. The fuel is introduced from the fuel inlet 11 into a fuel flow passage inside the central body 12, which is communicated with the internal fuel flow passages 21 inside the fuel nozzle vanes 25, and the fuel is then injected into an air stream via fuel injection holes 15 that pass through the walls of the fuel nozzle vanes 25.

Figure 3:
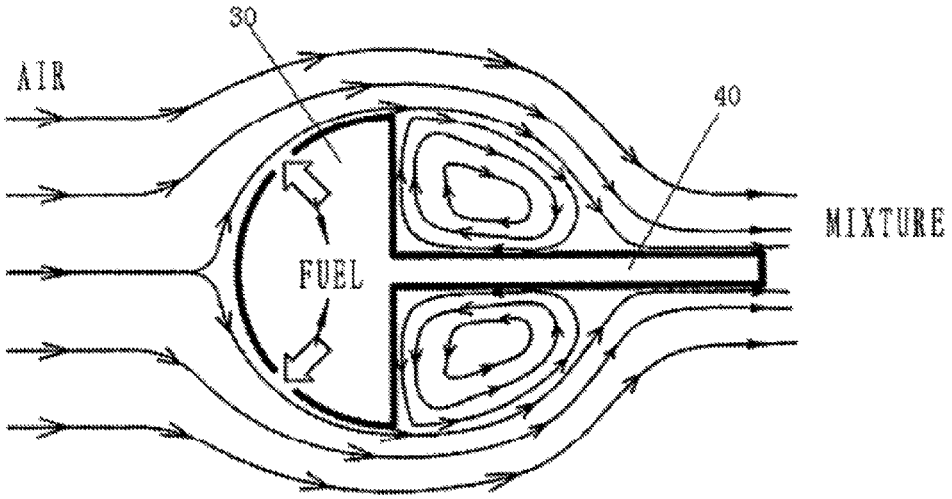
FIG. 3 is a schematic view of the flow around a typical fuel nozzle vane which is installed in the premixer according to one exemplary embodiment of the present invention.

FIG. 3 is a schematic view of the flow around a typical fuel nozzle vane which is installed in the premixer. The thin lines with arrows are the stream lines. The vane comprises a bluff forehead 30, which allows the premixer to adapt to heavily disordered incoming air stream, and a suddenly constringent thin tail 40. The flow separates from the bluff forehead 30 and each of the separated flow forms a small eddy at the immediate downstream of the forehead. This small eddy, which is steadily attached at the corner formed by the forehead base and the surface of the tail 40, plays a very important role to enhance the performance of the premixer. This small eddy works just like a blender, it sucks the uneven mixture which flows near the forehead wall, stirs them into uniform mixture and then discharges them downstream. In this process, the eddy can not only uniform the concentration of the mixture, but also the momentum and the temperature of the mixture too, it works like a damper to absorb and damp the turbulence within the air stream which is usually generated by the compressor and is very harmful to the flame stability in the combustor. The above structure may be applied to the mixing vanes 24. Specifically, as shown in FIG. 2, each of the mixing vanes 24 comprises a bluff forehead 30' and a suddenly constringent thin tail 40' to form mixing eddies which are symmetrically attached on both sides of the thin tail 40'.

In the present invention, the fuel and air mixture flows downstream inside the annular mixing passage 13 and the flow field is broken up by the arrayed vanes into a series of small regions to create a highly confined mixing flow which can successfully inhibit the generation of large scale turbulence in the mixing process. By using the mixing vane described above, each small flow region comprises a well designed mixing eddy which greatly enhances the mixing intensity of the flow field and effectively absorbs the turbulence in the air steam.

Adjusting the size and arrangement of the vanes can change the size and the spin velocity of the eddies, therefore the characteristics of the mixing and the turbulence absorbability will be effectively adjusted to adapt to a very wide range of operation conditions while keeping high premixing performance. The small size and high spin velocity of the eddies can achieve high intensity of heat and mass transfer rate through eddies' boundary with the main stream and eliminate the possibility of incurring auto-ignition and flashback because of lacking the flame holding mechanism.

Before reaching the exhaust of the premixer, swirl is imparted to the mixture of the fuel and air by airfoil shaped turning vanes 23, which are designed to minimize the disturbance to the flow field in this progress. Downstream the turning vanes, the fuel-air mixture flows into the reaction zone of the combustor, the central body ends 26 as a non-airfoil shape, such as flat or concaved, which causing the separation of the fuel-air mixture flow, forming a recirculation zone downstream the central body and improving the performance of flame holding.

The present invention relates to a gas turbine combustor having a reaction zone in which a mixture of air and fuel is combusted, wherein the combustor comprises the above premixer, and the mixture is injected from the premixer into the reaction zone.

Although several exemplary embodiments have been shown and described, it would be appreciated by those skilled in the art that various changes or modifications may be made in these embodiments without departing from the principles and spirit of the disclosure, the scope of which is defined in the appended claims and their equivalents.

What is claimed is:

1. A premixer for use in a combustor of a gas turbine, the premixer comprises:

a circular shroud and a cylinder central body which contains a fuel flow passage wherein the shroud and the central body confine an annular mixing passage between them, wherein an air inlet is located at an upstream end of the mixing passage and a fuel inlet is located at an upstream end of the fuel flow passage inside the central body, wherein fuel and air are premixed in the annular mixing passage into a mixture for injecting into a combustor reaction zone, and the mixing passage comprises a cascade of arrayed vanes including from upstream to downstream:

a plurality of fuel nozzle vanes, each comprising a forehead with curved outer surface and a thin tail along the middle line of the vane to form mixing eddies which are symmetrically attached on both sides of the thin tail, each of the fuel nozzle vanes further comprising multiple fuel injection holes on the wall thereof and an internal fuel flow passage communicated with the fuel passage inside the central body receiving the fuel from the fuel inlet, a plurality of mixing vanes, each comprising a forehead with curved outer surface and a thin tail along the middle line of the vane to form mixing eddies which are symmetrically attached on both sides of the thin tail, and a plurality of turning vanes imparting swirl to the incoming mixture.

2. The premixer according to claim 1, wherein each of the turning vanes is initially parallel with the axis of the central body, then bend circumferentially and the thickness of the vanes gradually reduced.

3. The premixer according to claim 1, wherein the central body comprises a non-airfoil downstream end, which causes the separation of the fuel-air mixture flow, forming a recirculation zone downstream the central body and improving the performance of flame holding.

4. A gas turbine combustor comprising:

a reaction zone in which a mixture of air and fuel is combusted, and a premixer the premixer comprising:

a circular shroud and a cylinder central body which contains a fuel flow passage wherein the shroud and the central body confine an annular mixing passage between them, wherein an air inlet is located at an upstream end of the mixing passage and a fuel inlet is located at an upstream end of the fuel flow passage inside the central body, wherein fuel and air are premixed in the annular mixing passage into the mixture for injecting into the combustor reaction zone, and the mixing passage comprises a cascade of arrayed vanes including from upstream to downstream:

a plurality of fuel nozzle vanes, each comprising a forehead with curved outer surface and a thin tail along the middle line of the vane to form mixing eddies which are symmetrically attached on both sides of the thin tail, each of the fuel nozzle vanes further comprising multiple fuel injection holes on the wall thereof and an internal fuel flow passage communicated with the fuel passage inside the central body receiving the fuel from the fuel inlet, a plurality of mixing vanes, each comprising a forehead with curved outer surface and a thin tail along the middle line of the vane to form mixing eddies which are symmetrically attached on both sides of the thin tail, and a plurality of turning vanes imparting swirl to the incoming mixture, and the mixture is injected from the premixer into the reaction zone.

5. The gas turbine combustor according to claim 4, wherein each of the turning vanes is initially parallel with the axis of the central body, then bend circumferentially and the thickness of the vanes gradually reduced.

6. The gas turbine combustor according to claim 4, wherein the central body comprises a non-airfoil downstream end, which causes the separation of the fuel-air mixture flow, forming a recirculation zone downstream the central body and improving the performance of flame holding.

* * * * *